US006731256B2

(12) United States Patent
Lin

(10) Patent No.: US 6,731,256 B2
(45) Date of Patent: May 4, 2004

(54) PLASMA DISPLAY PANEL WITH LOW FIRING VOLTAGE

(75) Inventor: Chu-Shan Lin, HsinChu (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 10/293,602

(22) Filed: Nov. 14, 2002

(65) Prior Publication Data

US 2003/0094905 A1 May 22, 2003

(30) Foreign Application Priority Data

Nov. 21, 2001 (TW) ..... 090128874

(51) Int. Cl.[7] ..... G09G 3/28

(52) U.S. Cl. ..... 345/66; 345/60; 345/63; 315/169.2

(58) Field of Search ..... 345/60–77, 91; 315/169.1–169.6

(56) References Cited

U.S. PATENT DOCUMENTS 6,448,947 B1 * 9/2002 Nagai ..... 3454/60
6,504,519 B1 * 1/2003 Ryu et al. ..... 345/60

* cited by examiner

*Primary Examiner*—Wilson Lee
(74) *Attorney, Agent, or Firm*—Rabin & Berdo, P.C.

(57) ABSTRACT

A plasma display panel (PDP) comprises a front substrate, a rear substrate, an addressing electrode, a common electrode, a first scan electrode, a second scan electrode, a first sustain electrode, and a second sustain electrode. The front substrate and a rear substrate are disposed apart in parallel, wherein a gas is filled there between. The addressing electrode positioned on the front substrate and the common electrode is positioned on the rear substrate and is orthogonal to the address electrode. The first scan electrode and the second scan electrode are positioned on the rear substrate, and are respectively at the first side and the second side of the common electrode. The first sustain electrode and the second sustain electrode are positioned on the rear substrate, and are respectively at the first side and the second side of the common electrode. A first pixel unit is defined by the address electrode, the common electrode, the first scan electrode, and the first sustain electrode. A second pixel unit is defined by the address electrode, the common electrode, the second scan electrode, and the second sustain electrode. A priming voltage is applied across the first scan electrode and the common electrode in an erasing period. Whether the first pixel unit is in bright status or not is determined by the address electrode and the first scan electrode in an addressing period. A plasma in the first pixel unit is driven by the first scan electrode, the first sustain electrode back and forth so as to sustain the bright status.

15 Claims, 4 Drawing Sheets

PLASMA DISPLAY PANEL WITH LOW FIRING VOLTAGE

This application incorporates by reference Taiwan application Serial No. 090128874, filed Nov. 21, 2001.

BACKGROUND OF THE INVENTION

1. Field of the Invention

The invention relates in general to a plasma display panel (PDP), and in particular, to a PDP with low firing voltage.

2. Description of the Related Art

The plasma display panel (PDP) has a great potential in the big-size flat display panel market. A conventional PDP usually requires a high firing voltage to transform an ionized gas into plasma. Driving the PDP at high voltage not only requires expensive driving and control components, but may also damages the components thus shortening their life spans.

FIG. 1 illustrates a cross-sectional view of the PDP 100 according to a conventional method. The PDP 100 includes a front substrate 102 and a rear substrate 104. The spacing between the front substrate 102 and the rear substrate 104 is filled with a mixture of inert gases. The rear substrate 102 has a plurality of sustain electrodes 108 and scan electrodes 110, which are arranged alternately and in parallel thereon. The front substrate 104 has an address electrode 106, which is orthogonal to the sustain electrode 108 and the scan electrode 110. Moreover, a dielectric layer 114 is positioned on the rear substrate 104, and is covered by a protective layer 116. A fluorescent layer 118 used for producing fluorescent light is positioned on the address electrode 106.

The PDP 100 also has a plurality of pixel units 122, and each pixel unit 122 includes an address electrode 106, a sustain electrode 108, and a scan electrode 110. When the voltage across the sustain electrode 108 and the scan electrode 110 is larger than the firing voltage, the electric field between these two electrodes causes the gas to transform into spatial charges. Then, the spatial charges are transformed into plasma by applying a voltage across the address electrode 106 and the scan electrode 110, and whether the generated wall charges have a sufficient density or not to light the plasma is also determined. The wall charges density is the critical factor in maintaining the pixel units in the bright (on) state or in the dark (off) state. If it is decided not to maintain the pixel unit in the bright state, the spatial charges of the pixel unit are quickly restored to gas. If it is decided to maintain the pixel unit in the bright state, the sustain electrode 108 and the scan electrode 110 drive the plasma in the pixel unit back and forth for continuous radiating ultraviolet rays. When ultraviolet rays are radiated to the fluorescent layer 118, the fluorescence will gleam and the gleamed light emitted by the pixel unit will be seen by the user through the transparent rear substrate 104.

The sustain electrode 108 includes an opaque electrode 124 made by Cr/Cu/Cr or other high conductivity material, and a transparent electrode 126 composed of the ITO. Similarly, the scan electrode 110 includes an opaque electrode 128 composed of Cr/Cu/Cr or other high conductivity material, and a transparent electrode 130 made by the ITO. The material of Cr/Cu/Cr has the characteristics of high conductivity and not being pervious to light. The material of ITO, though being pervious to part of the visible light, has larger resistance and is difficult in manufacturing.

The firing voltage is proportional to the voltage across the sustain electrode 108 and the scan electrode 110, and corresponds to the gap between those two. Therefore, the transparent electrodes 126, 130 are respectively used as sustain electrode 108 and the scan electrode 110 in order to decrease the gap and the firing voltage as well. However, the transparent electrodes 126, 130 also consume larger energy owing to the large resistance and decrease the luminescence efficiency by absorbing part of the visible light. Furthermore, the difficulty in manufacturing for the transparent electrodes 126, 130 decreases the yield of the PDP 100.

SUMMARY OF THE INVENTION

It is therefore an object of the invention to provide a plasma display panel (PDP) has low firing voltage, high illuminating efficiency, and high contrast without using the transparent electrode.

The PDP of the present invention comprises a front substrate, a rear substrate, an addressing electrode, a common electrode, a first scan electrode, a second scan electrode, a first sustain electrode, and a second sustain electrode. The front substrate and a rear substrate are disposed apart in parallel, wherein a gas is filled there between. The addressing electrode positioned on the front substrate and the common electrode is positioned on the rear substrate and is orthogonal to the address electrode. The first scan electrode and the second scan electrode are positioned on the rear substrate, and are respectively at the first side and the second side of the common electrode. The first sustain electrode and the second sustain electrode are positioned on the rear substrate, and are respectively at the first side and the second side of the common electrode. A first pixel unit is defined by the address electrode, the common electrode, the first scan electrode, and the first sustain electrode. A second pixel unit is defined by the address electrode, the common electrode, the second scan electrode, and the second sustain electrode. A priming voltage is applied across the first scan electrode and the common electrode in an erasing period. Whether the first pixel unit is in bright status or not is determined by the address electrode and the first scan electrode in an addressing period. A plasma in the first pixel unit is driven by the first scan electrode, the first sustain electrode back and forth so as to sustain the bright status.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
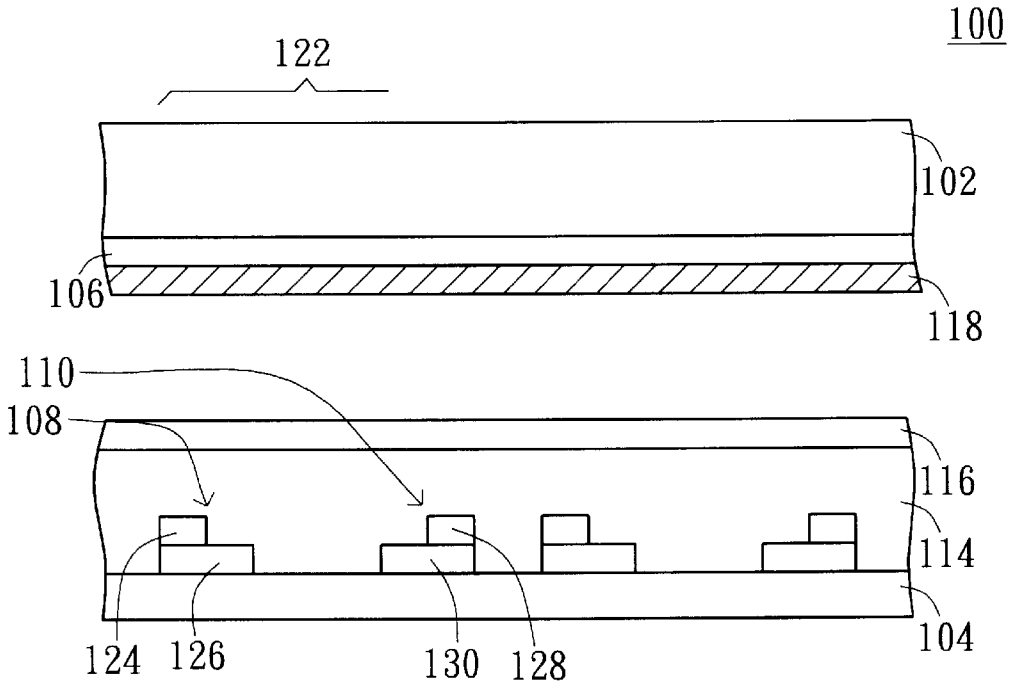
FIG. 1 (PRIOR ART)
FIG. 1 (Prior Art) illustrates a cross-sectional view of the plasma display panel (PDP) according to a conventional method.
Figure 2:
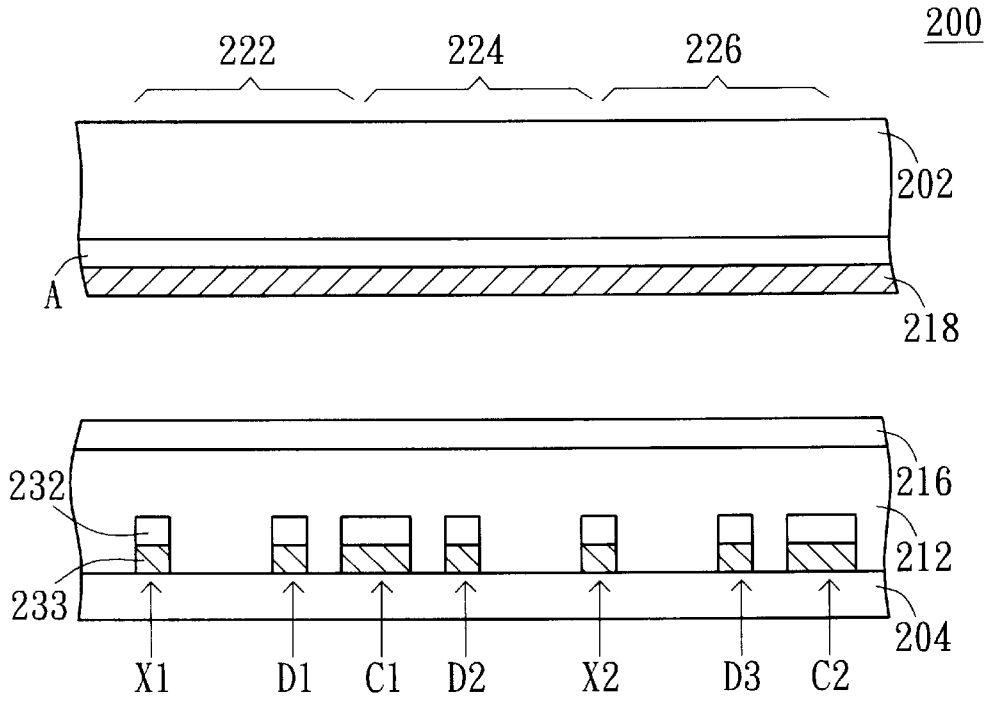
FIG. 2 illustrates a cross-sectional view of the PDP with low firing voltage according to a preferred embodiment of the present invention.

FIG. 2 illustrates a cross-sectional view of the plasma display panel (PDP) 200 with low firing voltage according to a preferred embodiment of the present invention. The PDP 200 includes a front substrate 202 and a rear substrate 204, which are disposed apart. The spacing between the front substrate 202 and the rear substrate 204 is filled with gas. The front substrate 202 has an address electrode A. The rear substrate 204 has common electrodes C1, C2, being orthogonal to the address electrode A, and a first scan electrode D1 and a second electrode D2, being respectively positioned at the left side and right side of the common electrode C1. The rear substrate 204 further has a first sustain electrode X1 and a second sustain electrode X2, which are respectively at the left side of the first scan electrode D1 and right side of the second scan electrode D2.

The PDP 200 includes a first pixel unit 222 and a second pixel unit 224. The first pixel unit 222 is defined by the address electrode A, the common electrode C1, the first scan electrode D1, and the first sustain electrode X1. The second pixel unit 224 is defined by the address electrode A, the common electrode C1, the second scan electrode D2, and the second sustain electrode X2. The PDP 200 can further includes a third pixel unit 226, which is defined by the address electrode A, the common electrode C2, the second sustain electrode X2, and a third scan electrode D3.

Figure 3:
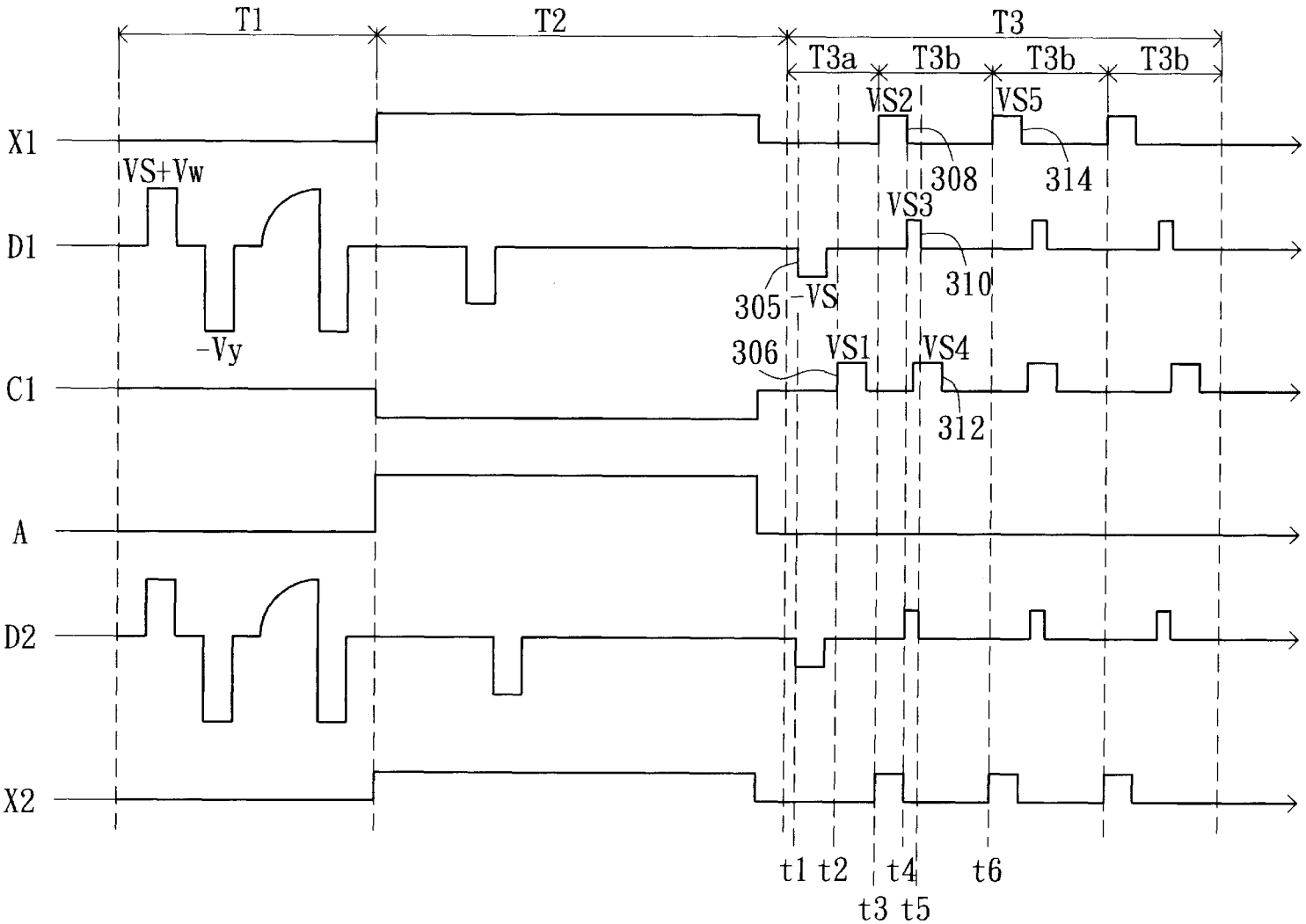
FIG. 3 illustrates the timing chart used for driving the PDP of FIG. 2 according to one embodiment of the present invention.

FIG. 3 illustrates the timing chart used for driving the PDP of FIG. 2 according to one embodiment of the present invention. The driving process of the PDP includes three periods: an erasing period T1, an addressing period T2, and a sustaining period T3.

In the erasing period T1, the voltages of same waveforms are applied to all pixel units. Here, the first pixel unit 222 is used as the example. Firstly, an erasing pulse of voltage (Vs+Vw) is applied to the first scan electrode D1 in order to remove the wall charges in the first pixel unit 222. Then, a pulse of −Vy is applied across the first scan electrode D1 and the common electrode C1 in order to produce the priming there between. In this way, the gas is ionized and becomes the spatial charges. Next, a positive pulse, increasing gradually with time, is applied to the first scan electrode D1 so as to induce a self-erase of the protective layer 216. Therefore, the accumulations of wall charges are equalized between all pixel units. Finally, a pulse of voltage −Vy is applied across the first scan electrode D1 and the common electrode C1 in order to make the gas become spatial charges and the wall charges again.

In the addressing period T2, the voltages applied to the address electrode and the all scan electrodes are determined by the image data to be displayed. The voltage, applied to the address electrode A and the first scan electrode D1, determine whether the first pixel unit 222 is in the bright status or not.

The sustaining period T3 includes a period T3*a* and some periods T3*b*, which respectively completes the pre-sustaining discharge operation and the repetitive main-sustaining discharge operations. In the sustaining period T3, the common electrode C1, the first scan electrode D1, and the first sustaining electrode X1 drive the plasma in the first pixel unit 222 back and forth for maintaining the displaying status.

During the period T3*a*, a first pre-sustaining voltage VS1 is applied across the common electrode C1 and the first scan electrode D1. For instance, the pre-sustaining discharge operation is implemented by step (a1) and step (a2). In step (a1), a voltage of −VS1 is applied to the first scan electrode D1 at timing t1 so as to produce the first pre-sustaining pulse 305 across the common electrode C1 and the first scan electrode D1. In the step (a2), a voltage of VS1 is applied to the common electrode C1 at timing t2 in order to produce the first pre-sustaining pulse 306 across the common electrode C1 and the first scan electrode D1.

During the period T3*b*, a voltage of VS2 is first applied to the sustain electrode X1 from the timing t3 to timing t4 so as to produce a second pre-sustaining pulse 308 across the sustain electrode X1 and the common electrode C1. Next, the common electrode C1, the first scan plasma D1, and the first sustain electrode X1 drive the plasma in the first pixel unit 222 back and forth by orderly applying voltages of VS3, VS4. Such that the discharging efficiency, illuminating efficiency, and the occupation space of the plasma are increased. The voltage of VS3 is applied to the first scan electrode D1 from the timing t4 to timing t5 so as to produce a first sustaining pulse 310 across the first scan electrode D1 and the first sustain electrode X1. Before the voltage of VS3 is vanished, the voltage of VS4 is applied to the common electrode C1 for producing a second sustaining pulse 312 across the common electrode and the first sustain electrode X1.

Then, the first scan electrode D1 is restored to a zero level in order to produce a zero voltage across the first scan electrode D1 and the first sustain electrode X1. Afterwards, a voltage of VS5 is applied to the sustain electrode X1 so as to produce a third sustaining pulse 314 across the sustain electrode X1 and the common electrode C1, and across the sustain electrode X1 and the first scan electrode D1 as well. Finally, the processes of producing pulses 308, 310, 312 and 314, during the main-sustaining periods T3*b*, are repeated, and their respective voltages VS2, VS3, VS4, and VS5 can be equal or un-equal.

FIGS. 4A to 4F illustrates the distribution of plasma in the first pixel unit 222, the second pixel unit 224, and the third pixel unit 226 at different timings, wherein the applied voltages VS1, VS2, VS3, VS4, VS5 are all equal. In the following description, only the plasma in the first pixel unit 222 is remarked.

Figure 4A:
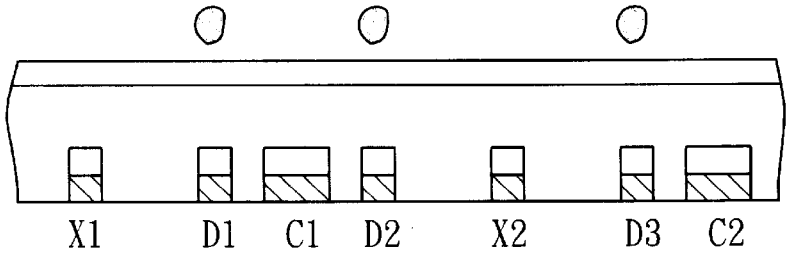
FIGS. 4A to 4F illustrate the distribution of plasma in the first pixel unit, the second pixel unit, and the third pixel unit at different timings, wherein the applied voltages VS1, VS2, VS3, VS4, VS5 are all equal.
Figure 4B:
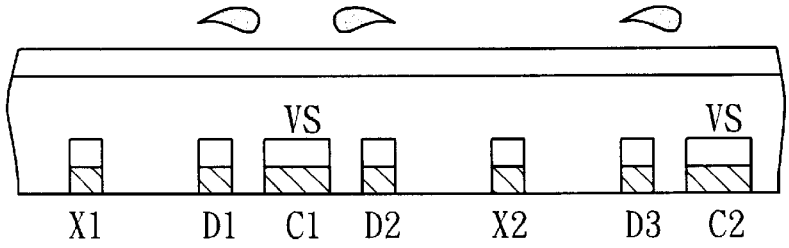
Figure 4C:
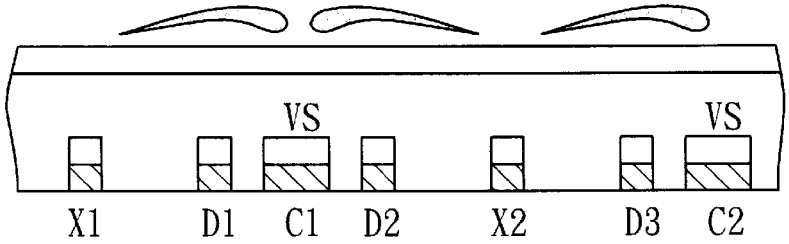

FIG. 4A shows the plasma is formed upon the first scan electrode D1 after the addressing period T2. FIG. 4B shows that plasma is distributed between the common electrode C1 and the first scan electrode D1 at timing t2, which is produced by the first pre-sustaining pulse 306 across the common electrode C1 and the first scan electrode D1. FIG. 4C shows the plasma being distributed all over the first pixel unit 222, between the common electrode C1 and the first sustain electrode X1, at timing t3 by applying the second pre-sustaining pulse 308 across the common electrode C1 and the first sustain electrode X1. In FIG. 4B and FIG. 4C, the firing voltages can be decreased by decreasing the gap between the first scan electrode D and the common electrode C.

Figure 4D:
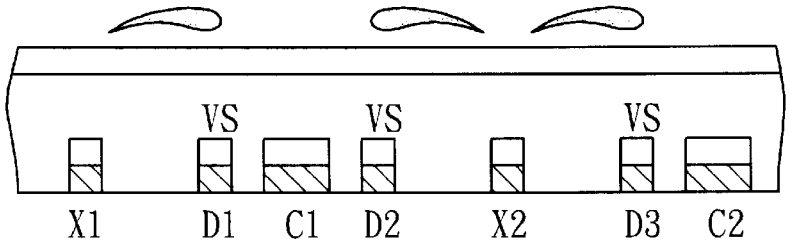
Figure 4E:
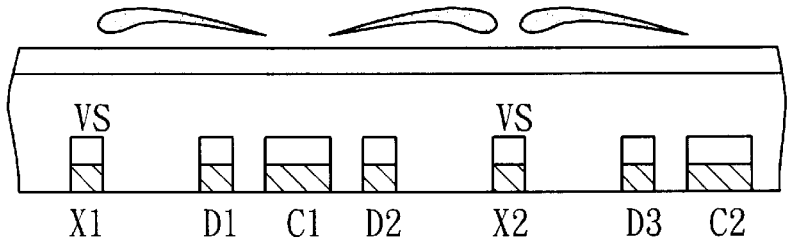

FIG. 4D shows the plasma being distributed between the first scan electrode D1 and the first sustain electrode X1 at timing t4 by applying the first sustaining pulse 310 across the first scan electrode D1 and the first sustain electrode X1. FIG. 4E shows the plasma being distributed between the common electrode C1 and the first sustain electrode X1 at timing t5 by applying the voltage of VS across the common electrode C1 and the first sustaining electrode X1. In FIG. 4D and FIG. 4E, the generated plasma is sustained in the first pixel unit 222 by first applying the voltage of VS to the first scan electrode D1 then to the common electrode C1, such that the generated plasma will not diminish owing to the spatial diffusion.

Figure 4F:
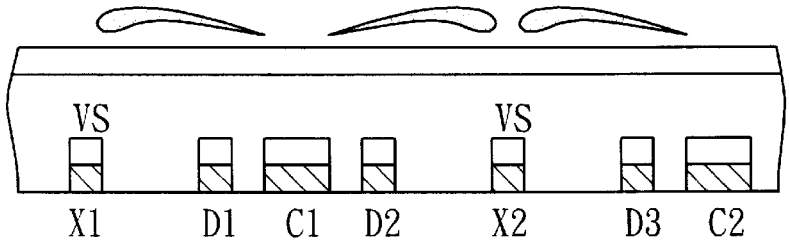

FIG. 4F shows the plasma being distributed towards the first sustain electrode X1 at timing t6 by applying a voltage of VS across the first sustain electrode X1 and the common electrode C1. Finally, the bright status of the first pixel unit 222 is kept by driving the plasma back and forth.

Figure 5:
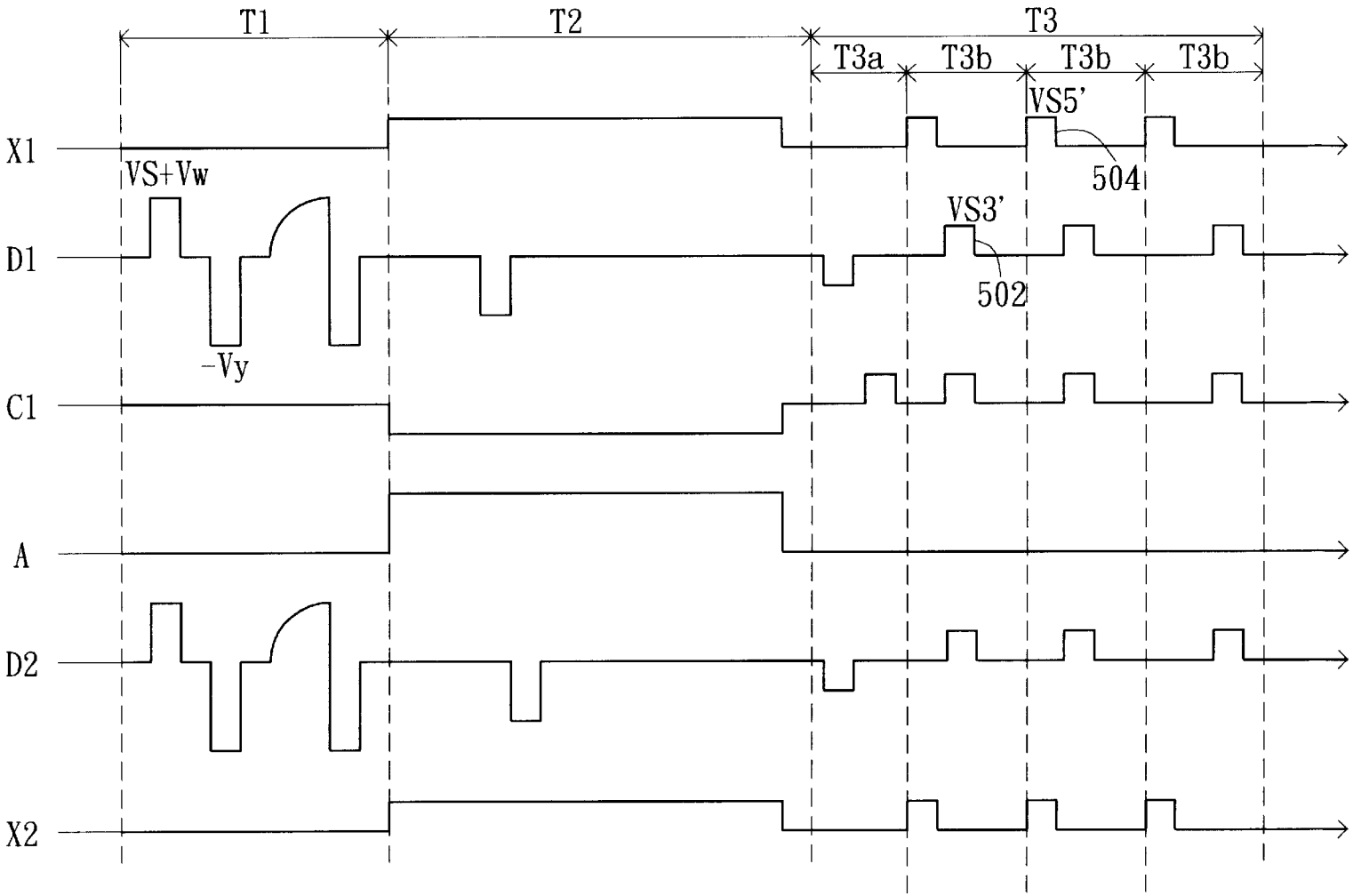
FIG. 5 illustrates the timing chart used for driving the PDP according to another embodiment of the present invention.

FIG. 5 illustrates the timing chart used for driving the PDP according to another embodiment of the present invention. Compared with the embodiment of FIG. 3, the embodiment of FIG. 5 applies the same voltages to the first scan electrode D1 and the common electrode C1 during the period T3*b*. Firstly, a voltage VS3' is applied to the first scan electrode D1 and the common electrode C1 so as to produce a first sustaining pulse 502 across the first scan electrode D1 and the first sustain electrode X1, and across the common electrode C1 and the first sustain electrode X1 as well. Then, a voltage VS5' is applied to the first sustain electrode X1 so as to produce a third sustaining pulse 504 across the first sustain electrode X1 and the first scan electrode D1, and across the first sustain electrode X1 and the common electrode C1 as well.

From the above description, there are some advantages in the present invention. First, the distances from scan electrode D1 to common electrode C1, and from scan electrode D2 to common electrode C1 are adjustable, and can be shorter than that between two adjacent transparent electrodes. Therefore, the firing voltage of the present invention is smaller than that of the conventional method, and accordingly the power consumption is lowered. Second, the interferences between pixel units can be avoid by adjusting the widths of the common electrode and the sustain electrodes.

Third, the electrodes of the present invention can be only composed of the Cr/Cu/Cr, such that the manufacturing process of the present invention is simplified and the yield is improved. Fourth, the transparent electrode of ITO is not used in the present invention, and the area transmitted by the light is increased. Fifth, the priming process, as well as the erasing process, occurs merely within the area between the common electrode and the scan electrode. In this way, the small erasing area decreases the background brightness and increases the contrast.

Sixth, the black matrix 233 of CrOx, positioned below the electrode 232 of Cr/Cu/Cr, can reduce reflectivity that the exterior light reflected by the electrode 232 of Cr/Cu/Cr. Compared with the independent manufacturing of the conventional method, the black matrix 233 of CrOx and the electrode 232 of Cr/Cu/Cr can be formed at the same time in the present invention, which simplifies the fabrication and improves the yield. Finally, compared with the discharging space enclosed between the transparent electrodes for the conventional method, the discharging space of the present invention expands in the whole pixel unit, and thus the illuminating efficiency is increased.

While the invention has been described by way of example and in terms of the preferred embodiment, it is to be understood that the invention is not limited to the disclosed embodiment. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A plasma display panel (PDP) comprising:

a front substrate and a rear substrate disposed apart in parallel, wherein a discharge gas is filled there between;

an address electrode positioned on said front substrate;

a common electrode positioned on said rear substrate and orthogonal to said address electrode;

a first scan electrode and a second scan electrode positioned on said rear substrate, said first scan electrode and said second scan electrode respectively at the first side and the second side of said common electrode;

a first sustain electrode and a second sustain electrode positioned on said rear substrate, said first sustain electrode and said second sustain electrode respectively at the first side and the second side of said common electrode;

wherein said address electrode, said common electrode, said first scan electrode, and said first sustain electrode defines a first pixel unit, and said address electrode, said common electrode, said second scan electrode, and said second sustain electrode defines a second pixel unit; and wherein a priming voltage is applied across said first scan electrode and said common electrode in an erasing period, whether said first pixel unit is in bright status or not is determined by said address electrode and said first scan electrode in an addressing period, a plasma in said first pixel unit is driven by the common electrode, said first scan electrode, said first sustain electrode back and forth so as to sustain said first pixel unit being in bright status.

2. The PDP according to claim 1, wherein said first scan electrode is positioned between said common electrode and said first sustain electrode.

3. The PDP according to claim 1, wherein said first scan electrode is composed of opaque material of Cr/Cu/Cr.

4. The PDP according to claim 1, wherein said first scan electrode is nearer to said common electrode than said first sustain electrode.

5. The PDP according to claim 1, wherein said first sustain electrode is composed of opaque material of Cr/Cu/Cr.

6. A method for driving a plasma display panel (PDP), said PDP having a front substrate and a rear substrate disposed apart in parallel, wherein a gas is filled there between; an addressing electrode positioned on said front substrate; a common electrode positioned on said rear substrate and orthogonal to said address electrode; a first scan electrode and a second scan electrode positioned on said rear substrate and orthogonal to said address electrode, said first scan electrode and said second scan electrode respectively at the first side and the second side of said common electrode; a first sustain electrode and a second sustain electrode positioned on said rear substrate and orthogonal to said address electrode, said first sustain electrode and said second sustain electrode respectively at the first side and the second side of said common electrode, wherein said address electrode, said common electrode, said first scan electrode, and said first sustain electrode defines a first pixel unit, and said address electrode, said common electrode, said second scan electrode, and said second sustain electrode defines a second pixel unit, said method comprising:

applying a first pre-sustain pulse across said common electrode and said first scan electrode in a sustaining period;

applying a second pre-sustain pulse across said common electrode and said first sustain electrode in said sustaining period; and driving a plasma in said first pixel unit by said common electrode, said first scan electrode and said first sustain electrode so as to sustain the bright status of said first pixel unit.

7. The method according to claim 6, wherein said first scan electrode is positioned between said common electrode and said first sustain electrode.

8. The method according to claim 6, wherein said first scan electrode is composed of opaque material of Cr/Cu/Cr.

9. The method according to claim 6, wherein said first scan electrode is nearer to said common electrode than said first sustain electrode.

10. The method according to claim 6, wherein said first sustain electrode is composed of opaque material of Cr/Cu/Cr.

11. The method according to claim 6, wherein the step of applying a first pre-sustain pulse comprising:

applying a negative voltage to said first sustain electrode and a positive voltage to said common electrode so as to produce a first pre-sustain pulse across said common electrode and said first scan electrode; and applying a positive voltage to said common electrode so as to produce a first pre-sustain pulse across said common electrode and said first scan electrode.

12. The method according to claim 6, wherein the step of applying a second pre-sustain pulse comprising:

applying a positive voltage to said first sustain electrode so as to produce a second pre-sustain pulse across said common electrode and said first scan electrode.

13. The method according to claim 6, wherein the driving step comprising:

applying a first sustain pulse across said first scan electrode and said first sustain electrode;

applying a second sustain pulse across said common electrode and said first sustain electrode;

applying a zero voltage across said first scan electrode and said first sustain electrode; and applying a third sustain pulse across said first sustain electrode and said first scan electrode, and across said first sustain electrode and said common electrode as well.

14. The method according to claim 6, wherein the driving step comprising:

applying a first sustain pulse across said first scan electrode and said first sustain electrode, and across said common electrode and said first sustain electrode as well;

applying a third sustain pulse across said first sustain electrode and said first scan electrode, and across said first sustain electrode and said common electrode as well.

15. A method for driving a plasma display panel (PDP), said PDP having a front substrate and a rear substrate disposed apart in parallel, wherein a gas is filled there between; an addressing electrode positioned on said front substrate; a common electrode positioned on said rear substrate and orthogonal to said address electrode; a first scan electrode and a second scan electrode positioned on said rear substrate, said first scan electrode and said second scan electrode respectively at the first side and the second side of said common electrode; a first sustain electrode and a second sustain electrode positioned on said rear substrate, said first sustain electrode and said second sustain electrode respectively at the first side and the second side of said common electrode, wherein said address electrode, said common electrode, said first scan electrode, and said first sustain electrode defines a first pixel unit, and said address electrode, said common electrode, said second scan electrode, and said second sustain electrode defines a second pixel unit, said method comprising:

applying a first pre-sustain pulse across said common electrode and said first scan electrode so as to executing a pre-sustain discharge process;

applying a second pre-sustain pulse across said first sustain electrode and said common electrode in said sustaining period so as to executing said pre-sustain discharge process; and driving a plasma in said first pixel unit back and forth by said common electrode, said first scan electrode and said sustain electrode so as to sustain the bright status of said first pixel unit and executing a main-sustain discharge process.

* * * * *